United States Patent [19]

Stroble et al.

[11] 4,272,696

[45] Jun. 9, 1981

[54] PRELOADED BEARING ASSEMBLY FOR ROTATING ANODE X-RAY TUBES

[75] Inventors: Reimann L. Stroble, Milwaukee; Robert E. Hueschen, Hales Corners; Richard A. Jens, Milwaukee, all of Wis.

[73] Assignee: General Electric Company, Schenectady, N.Y.

[21] Appl. No.: 85,357

[22] Filed: Oct. 16, 1979

[51] Int. Cl.[3] ..... H01J 35/04

[52] U.S. Cl. ..... 313/60

[58] Field of Search ..... 313/60, 149

[56] References Cited

U.S. PATENT DOCUMENTS 2,786,954 3/1957 Atlee ..... 313/60

*Primary Examiner*—Robert Segal

*Attorney, Agent, or Firm*—Wheeler, House, Fuller & Hohenfeldt

[57] ABSTRACT

The glass envelope of a rotating anode x-ray tube has a tubular stem sealed into it. A rotor shaft which supports the x-ray target and induction rotor is coaxial with the tubular stem. The front ball bearing for the shaft has its outer race fixed in the end of the tubular stem and its inner race fixed on the shaft. The rear bearing has its inner race fixed on the shaft and its outer race fixed in a bearing retainer sleeve which is axially yieldable in the tubular stem. A coil spring is interposed between one end of the stem and the bearing retainer sleeve to force the outer race, balls and inner race of the bearings into good electric current exchange contact during rotor operation and to accommodate thermal expansion.

3 Claims, 3 Drawing Figures

PRELOADED BEARING ASSEMBLY FOR ROTATING ANODE X-RAY TUBES

This invention relates to rotating anode x-ray tubes.

It is common practice to support the rotor assembly of a rotating anode x-ray tube on axially spaced apart self-lubricated ball bearings where the inner races of the ball bearings are fixed to the rotor shaft and the outer races are fixed to a stationary stem, or vice versa. In some designs, at least one of the ball bearings has its balls between flat or ungrooved inner or outer races to allow for thermal expansion of the rotor assembly which is quite significant because the bearings and their associated parts may reach 500° C. during tube operation. A major cause of rotating anode x-ray tube failures results from the bearings becoming highly stressed under the influence of thermal expansion in which case the bearings often seize or, at least become rough and noisy. In rotating anode x-ray tubes, the ball bearings not only conduct heat but they are obliged to conduct anode current as well at high operating temperatures. If the balls are not kept in continuous contact with their races, sparking occurs between the balls and races which roughens the bearings and results in premature failure.

SUMMARY OF THE INVENTION

The primary object of the present invention is to overcome the above-noted problems.

In the improved x-ray tube described herein, a tubular stem is sealed into the tube envelope. The shaft which supports the rotating anode structure and the x-ray tube target is internally coaxial with the stem. A front end ball bearing has its inner race clamped on the shaft and its outer race fixed in the non-rotating stem. The rear bearing has its inner race clamped on the innermost end of the rotor shaft and its outer race fixed in a tubular bearing retainer which is free to move axially within the stationary stem. A coil spring, surrounding the shaft, is interposed effectively between the outer race of the front bearing and the axially yieldable retainer for the rear bearing outer race. The spring keeps a force on the outer races of the bearings which is transmitted to the balls and inner races so that good electrical contact is maintained during tube operation. Yieldability of the bearing retainer against the spring force enables the bearings, shaft and stationary stem to equalize thermal expansion and avoid developing undue stresses on the bearings. The arrangement desirably permits ball bearings which have grooved inner and outer races to be used.

U.S. Pat. No. 2,786,954 discloses a rotating anode x-ray tube in which a coil spring is used to apply an axial pressure to the inner races of axially spaced apart front and rear bearings for the rotor. One object of that patent is to compensate for bearing wear with the spring. It is perceived, however, that the bearing balls will bounce and spark and that on frequent occasions one ball may have to carry the entire x-ray tube current which will cause overheating and premature bearing failure. The main object of the cited patent is to provide an x-ray tube that is easy to assemble but the disclosure does not address the bearing bounce, electrical conductivity, thermal stress and bearing noise problems.

How the aforementioned general object and other more specific objects of the invention are achieved will be evident in the ensuing more detailed description of a preferred embodiment of the invention which will now be set forth in reference to the drawings.

DESCRIPTION OF A PREFERRED EMBODIMENT

Figure 1:
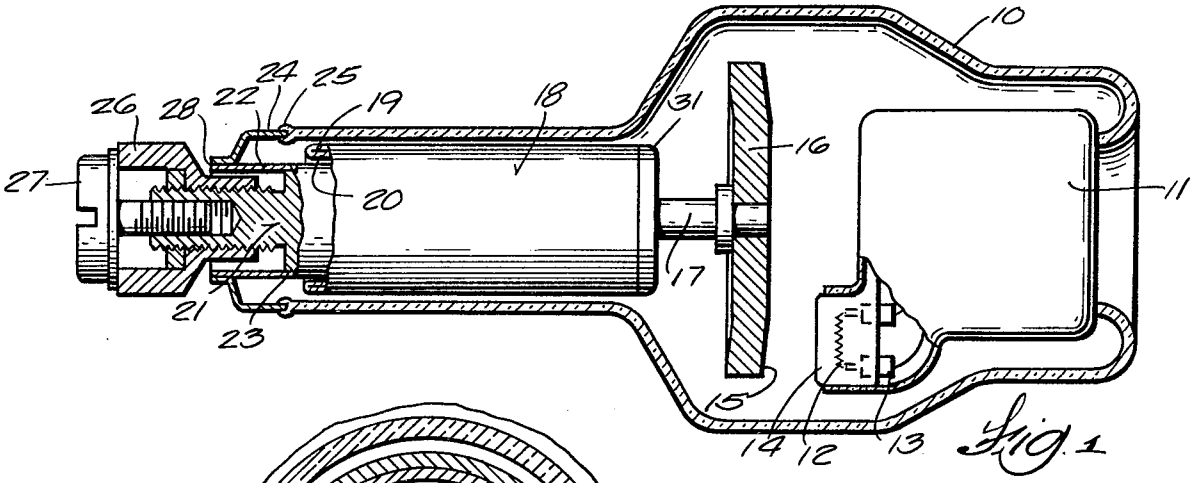
FIG. 1 is longitudinal sectional view of a rotating anode x-ray tube which embodies the invention and which has some parts broken away to reveal other parts.

FIG. 1 depicts conventional parts of a rotating anode x-ray tube in which the new preloaded bearing arrangement may be employed. The x-ray tube comprises a glass envelope 10 which, at one end, has a cathode support 11 sealed into it. A filament or cathode 12 is mounted on insulators 13 and located in a focusing cup 14 which focuses an electron beam against the beveled annular focal track area 15 of the rotating x-ray target 16. Target 16 is supported on a stem 17 which extends from a rotor assembly which is generally designated by the reference numeral 18. This is a traditional rotor in which a magnetic field is induced to cause it to rotate. The induction coils for producing the field are not shown. The rotor comprises an outer sleeve 19 of copper laminated to an inner sleeve 20 of ferrous metal.

Figure 2:
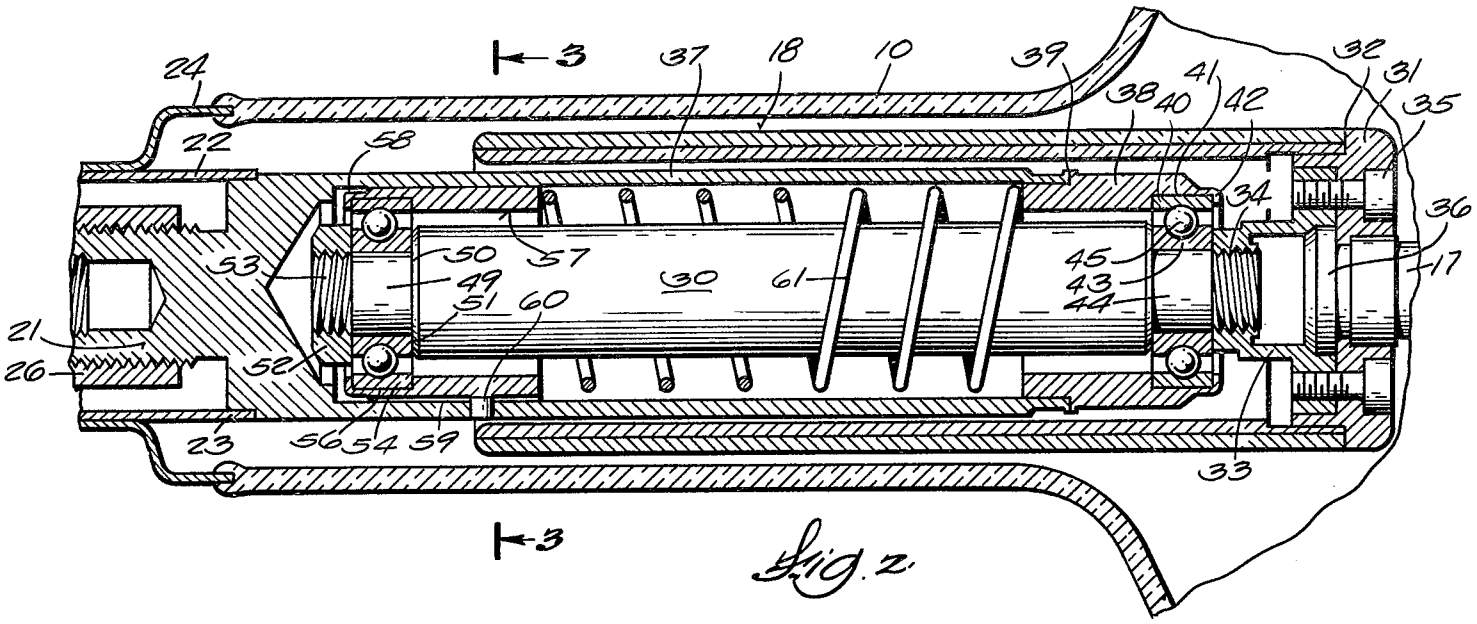
FIG. 2 is an enlarged longitudinal section of the rotor assembly isolated from the x-ray tube shown in FIG. 1.

As will be more evident later when FIG. 2 is discussed, the rotor is rotatable on a stem which is generally designated by the reference numeral 21 in FIG. 1. The stem has a tube 22 brazed to it in the region marked 23. One end of metal tube 22 is brazed at 23 to a ferrule 24 which is sealed into the end 25 of tube envelope 10. Stem 21 has a collar 26 screwed or brazed onto it and there is a screw 27 which is used for supporting the tube in its casing and for making an electrical connection to it. Attention is now invited to FIG. 2 which shows that rotor assembly 18 is mounted to a shaft 30. Rotor 18 terminates in an end cap 31 which is brazed to the rotor sleeve in the annular region marked 32. A collar 33 is turned on to the threaded front end 34 of shaft 30. End cap 31 of the rotor assembly is clamped to collar 33 by means of a plurality of inset socket-headed screws 35. Shouldered portions 36 of x-ray tube target supporting stem 17 are captured between collar 33 and end cap 31.

The main rotor supporting stem 21 has an integral tubular or internally cylindrical portion 37 which is stationary and which has a front stationary bearing retainer 38 fastened to it as by means of TIG welding around the interface marked 39. The outer race 40 of the front ball bearing is set in a counterbore 41 of bearing retainer 38. The outer race is secured in the counterbore by the swaged end 42 on the bearing retainer. The inner race 43 of the front bearing is fitted on a smooth reduced diameter portion 44 of shaft 30 and is retained by the screwed on collar 33. Note that the inner and outer races have outer and inner annular grooves, respectively, in which the circular row of bearing balls 45 are disposed.

The inner or rear end of shaft 30 has a reduced diameter portion 49 which defines a shoulder 50. The inner race 51 of a double grooved ball bearing is clamped on shaft portion 49 against shoulder 50 by means of a nut 52 which screws onto the thread 53 at the end of shaft 30.

Figure 3:
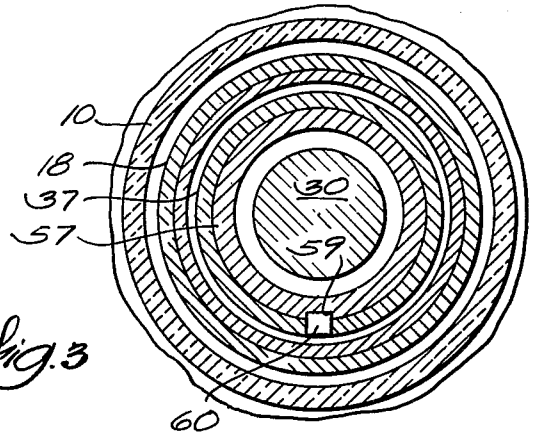
FIG. 3 is a transverse section taken on a line corresponding with 3—3 in FIG. 2.

The outer race 54 of the rear ball bearing resides in a shouldered counterbore 56 in a bearing retainer tube or sleeve which is generally designated by the reference numeral 57. Outer race 54 is secured in the shouldered counterbore 56 with the swaged end 58 of rear bearing retainer 57. The bearing retainer fits closely within the bore of stationary tubular stem 37 and the retainer can yield or move axially by a small amount within the bore of stem 37. Retainer 57 has a longitudinally extending narrow groove 59 on its outer periphery as can be seen in FIGS. 2 and 3. A pin 60 is welded, preferably by means of a laser beam, into a suitable opening through stationary tubular stem 37. The end of the pin extends into groove 59 of retainer 57 to prevent the retainer from rotating while still permitting it to move axially.

A preloaded coil spring 61 is interposed between front bearing retainer 38 and axially movable bearing retainer 57. This spring reacts against the bearing retainers and imposes a force on the outer races, particularly on the outer races 40 and 54 of the front and rear bearings, respectively. Considering the rear bearing, one may see that this force maintains outer race in good contact relation with the balls of the bearing and the force is further transmitted through the balls to the inner race for maintaining good contact with it. Since the spring does not rotate and it keeps a constant force on retainer 57 which also does not rotate, the constant force is maintained on the bearings so that no ball bounce can occur at any time. There are, of course, parallel current paths through the front and rear bearings which, under the influence of the mutual reaction on the bearings by the spring develop substantially equal contact pressure and divide the current flow through the x-ray tube equally.

It will be evident from a study of the relationship of the parts that any unequal thermal expansion between the outer stationary tubular stem 37 and the inner shaft 30 and its associated parts will always be compensated for by the outer races being pressed in one direction or yielding in the other direction with and against the force of spring 61.

By way of example of the materials used, in a commercial embodiment, spring 61 is composed of molybdenum, shaft 30 is type 410 stainless steel, rear bearing retainer 57 is type 304 stainless steel, nut 52 is type 410 stainless steel, front bearing retainer 38 is 300 or 304 Series stainless steel, and the bearing balls and interfacing races are silver coated for lubricating purposes.

A preferred embodiment of the invention has been described in detail but the true scope of the invention is to be determined by interpreting the claims which follow.

We claim:

1. A rotating anode x-ray tube comprising:

an envelope, a stem member sealed into said envelope and having a part extending to the outside of said envelope for making an external electrical connection to it and having a tubular part extending inside of said envelope, a shaft having first and second end portions and being arranged coaxially inside of said tubular part of said stem member, and a rotor assembly including a rotor sleeve mounted to the first end portion of said shaft which projects from said tubular part, said sleeve surrounding said tubular part and being coaxial with said shaft, a stud projecting axially from said rotor sleeve and an x-ray target supported on said stud, an axially yieldable non-rotating bearing retainer located inside of said tubular part of said stem member in proximity with the second end portion of said shaft, shoulder means inside of said tubular part axially spaced from said retainer and spring means interposed in compressive condition between said shoulder means and said bearing retainer, a first ball bearing having an externally grooved inner race and an internally grooved outer race with balls disposed around said grooves, said inner race being secured on the first end portion of said shaft and said outer race being secured in said tubular part of said stem member, and a second ball bearing having an externally grooved inner race and an internally grooved outer race with balls disposed around said grooves, said inner race being secured on said second end portion of said shaft and said outer race being secured in said axially yieldable bearing retainer, said spring means being operative to apply an axially directed spring means for applying an axially directed force to said axially yieldable bearing retainer and to the outer race of said second bearing secured therein to thereby maintain said balls in continuous contact with the grooves in said outer and inner races when said rotor assembly is rotating.

2. The x-ray tube as in claim 1 wherein:

said axially yieldable bearing retainer is tubular and has an outside diameter corresponding substantially with the inside diameter of said tubular part of said stem member, said axially yieldable tubular retainer having an axially extending slot, and pin means extending from said stem member into said slot for enabling said axially yieldable retainer to move axially and for preventing it from rotating.

3. The x-ray tube as in any of claims 1 or 2 wherein:

said first and second end portions of said shaft are reduced in diameter to define axially spaced apart shoulders and there are external threads on said reduced diameter portions extending to their ends, the inner races of said first and second bearings being fitted onto said shoulders respectively, and nut means turned onto said threaded ends, respectively, for pressing said inner races against the shoulders, said axially yieldable bearing retainer being generally tubular and having an outside diameter corresponding substantially with the inside diameter of said tubular part of said stem member, said tubular element having an internal counterbore for receiving the outer race of said second ball bearing.

* * * * *

UNITED STATES PATENT AND TRADEMARK OFFICE

CERTIFICATE OF CORRECTION

PATENT NO. : 4,272,696

DATED : June 9, 1981

INVENTOR(S) : Reimann L. Stroble; Robert E. Hueschen; Richard A. Jens

It is certified that error appears in the above—identified patent and that said Letters Patent is hereby corrected as shown below:

Column 4, Line 46, Claim 3 "claims 1 or 2" should read --claim 1--

Signed and Sealed this

*Eighth* Day of *December 1981*

[SEAL]

*Attest:*

GERALD J. MOSSINGHOFF

*Attesting Officer* *Commissioner of Patents and Trademarks*